US008929781B2

(12) United States Patent
Yoshioka et al.

(10) Patent No.: US 8,929,781 B2
(45) Date of Patent: Jan. 6, 2015

(54) DEVELOPING DEVICE AND IMAGE FORMING APPARATUS

(75) Inventors: Sakae Yoshioka, Kanagawa (JP); Shinichiro Fujimori, Kanagawa (JP); Masanori Kato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 170 days.

(21) Appl. No.: 13/604,247

(22) Filed: Sep. 5, 2012

(65) Prior Publication Data

US 2013/0243493 A1 Sep. 19, 2013

(30) Foreign Application Priority Data

Mar. 14, 2012 (JP) ..... 2012-057159

(51) Int. Cl.
*G03G 15/09* (2006.01)

(52) U.S. Cl.
CPC ..... *G03G 15/0921* (2013.01)
USPC ..... 399/277; 399/274; 399/267

(58) Field of Classification Search
CPC ..... G03G 15/0812; G03G 15/0921; G03G 2215/0648
USPC ..... 399/269, 274, 277, 267
See application file for complete search history.

(56) References Cited

U.S. PATENT DOCUMENTS

| | | | | |
|---|---|---|---|---|
| 5,223,898 | A * | 6/1993 | Fujii et al. | 399/254 |
| 5,995,790 | A * | 11/1999 | Takeda | 399/274 |
| 6,269,235 | B1 * | 7/2001 | Nishiyama | 399/267 |
| 6,330,414 | B1 * | 12/2001 | Takuma et al. | 399/267 |
| 7,466,946 | B2 * | 12/2008 | Tsujita et al. | 399/269 |
| 8,331,832 | B2 * | 12/2012 | Ikeda et al. | 399/269 |
| 8,401,440 | B2 * | 3/2013 | Oba et al. | 399/269 |
| 8,676,097 | B2 * | 3/2014 | Hirota et al. | 399/269 |
| 2004/0076454 | A1 | 4/2004 | Nishiyama | |
| 2014/0016969 | A1 * | 1/2014 | Yoshii | 399/269 |

FOREIGN PATENT DOCUMENTS

| | | | |
|---|---|---|---|
| JP | 2000-98749 | A | 4/2000 |
| JP | 2002-372868 | A | 12/2002 |
| JP | 2007-206508 | A | 8/2007 |

* cited by examiner

*Primary Examiner* — David Gray
*Assistant Examiner* — Carla Therrien
(74) *Attorney, Agent, or Firm* — Sughrue Mion, PLLC

(57) ABSTRACT

A developing device includes a first developer carrier that carries developer on a peripheral surface thereof; a second developer carrier that carries the developer on a peripheral surface thereof; a supplying section that supplies the developer to the peripheral surface of the first developer carrier; a layer thickness regulating member that regulates a layer thickness of the developer supplied to the peripheral surface of the first developer carrier by the supplying section; a first transfer magnetic pole disposed in an interior of the first developer carrier; a second transfer magnetic pole disposed in an interior of the second developer carrier; a first downstream magnetic pole disposed in the interior of the first developer carrier; and a second downstream magnetic pole disposed in the interior of the second developer carrier.

5 Claims, 8 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2012-057159 filed Mar. 14, 2012.

BACKGROUND (i) Technical Field

The present invention relates to a developing device and an image forming apparatus.

(ii) Related Art

Hitherto, a developing device that develops an electrostatic latent image on an image carrier using developer containing charged toner, and an image forming apparatus that includes such a developing device and that forms a toner image are known. In recent years, for example, a developing device including magnet rollers that, by rotating while carrying the developer by magnetic force, transport developer to an image carrier is proposed.

SUMMARY

According to an aspect of the invention, there is provided a developing device including a first developer carrier that carries developer on a peripheral surface thereof and that rotates in a peripheral direction of the peripheral surface, the developer containing toner and a magnetic material; a second developer carrier that carries the developer on a peripheral surface thereof and that rotates in a peripheral direction of the peripheral surface of the second developer carrier, the peripheral surface of the second developer carrier opposing the peripheral surface of the first developer carrier, a portion of the peripheral surface of the first developer carrier and a portion of the peripheral surface of the second developer carrier that oppose each other moving in a same direction; a supplying section that supplies the developer to the peripheral surface of the first developer carrier; a layer thickness regulating member that regulates a layer thickness of the developer supplied to the peripheral surface of the first developer carrier by the supplying section; a first transfer magnetic pole that is disposed in an interior of the first developer carrier, the first transfer magnetic pole being positioned downstream in a direction of movement of the peripheral surface of the first developer carrier from a position where the layer thickness of the developer is regulated by the layer thickness regulating member, the first transfer magnetic pole contributing to transfer of the developer from the first developer carrier to the second developer carrier; a second transfer magnetic pole that is disposed in an interior of the second developer carrier, the second transfer magnetic pole being positioned downstream in a direction of movement of the peripheral surface of the second developer carrier from the position where the layer thickness of the developer is regulated by the layer thickness regulating member, the second transfer magnetic pole contributing to, along with the first transfer magnetic pole, the transfer of the developer, a polarity of the second transfer magnetic pole being opposite to that of the first transfer magnetic pole; a first downstream magnetic pole that is disposed in the interior of the first developer carrier, the first downstream magnetic pole being positioned downstream from the first transfer magnetic pole in the direction of movement of the peripheral surface of the first developer carrier, the first downstream magnetic pole causing the developer to be carried by the peripheral surface of the first developer carrier, a polarity of the first downstream magnetic pole being opposite to that of the first transfer magnetic pole; and a second downstream magnetic pole that is disposed in the interior of the second developer carrier, the second downstream magnetic pole being positioned downstream from the second transfer magnetic pole in the direction of movement of the peripheral surface of the second developer carrier, the second downstream magnetic pole causing the developer to be carried by the peripheral surface of the second developer carrier, a polarity of the second downstream magnetic pole being opposite to that of the second transfer magnetic pole. The developer that is carried by the peripheral surface of the first developer carrier and that moves while standing in the form of a chain from the peripheral surface of the first developer carrier by a magnetic field is such that a chain standing height from the peripheral surface of the first developer carrier when the developer passes between a point where a total of magnetic field strengths becomes zero and the peripheral surface of the first developer carrier is less than a distance between the point where the total of magnetic field strengths becomes zero and the peripheral surface of the first developer carrier, the point where the total of magnetic field strengths becomes zero being where the total of magnetic field strengths of the first transfer magnetic pole, the second transfer magnetic pole, the first downstream magnetic pole, and the second downstream magnetic pole becomes zero. The developer that is carried by the peripheral surface of the second developer carrier and that moves while standing in the form of a chain from the peripheral surface of the second developer carrier by a magnetic field is such that a chain standing height from the peripheral surface of the second developer carrier when the developer passes between the point where the total of magnetic field strengths becomes zero and the peripheral surface of the second developer carrier is less than a distance between the point where the total of magnetic field strengths becomes zero and the peripheral surface of the second developer carrier.

BRIEF DESCRIPTION OF THE DRAWINGS

An exemplary embodiment of the present invention will be described in detail based on the following figures, wherein.

DETAILED DESCRIPTION

An exemplary embodiment of the invention will hereunder be described with reference to the drawings.

Figure 1:
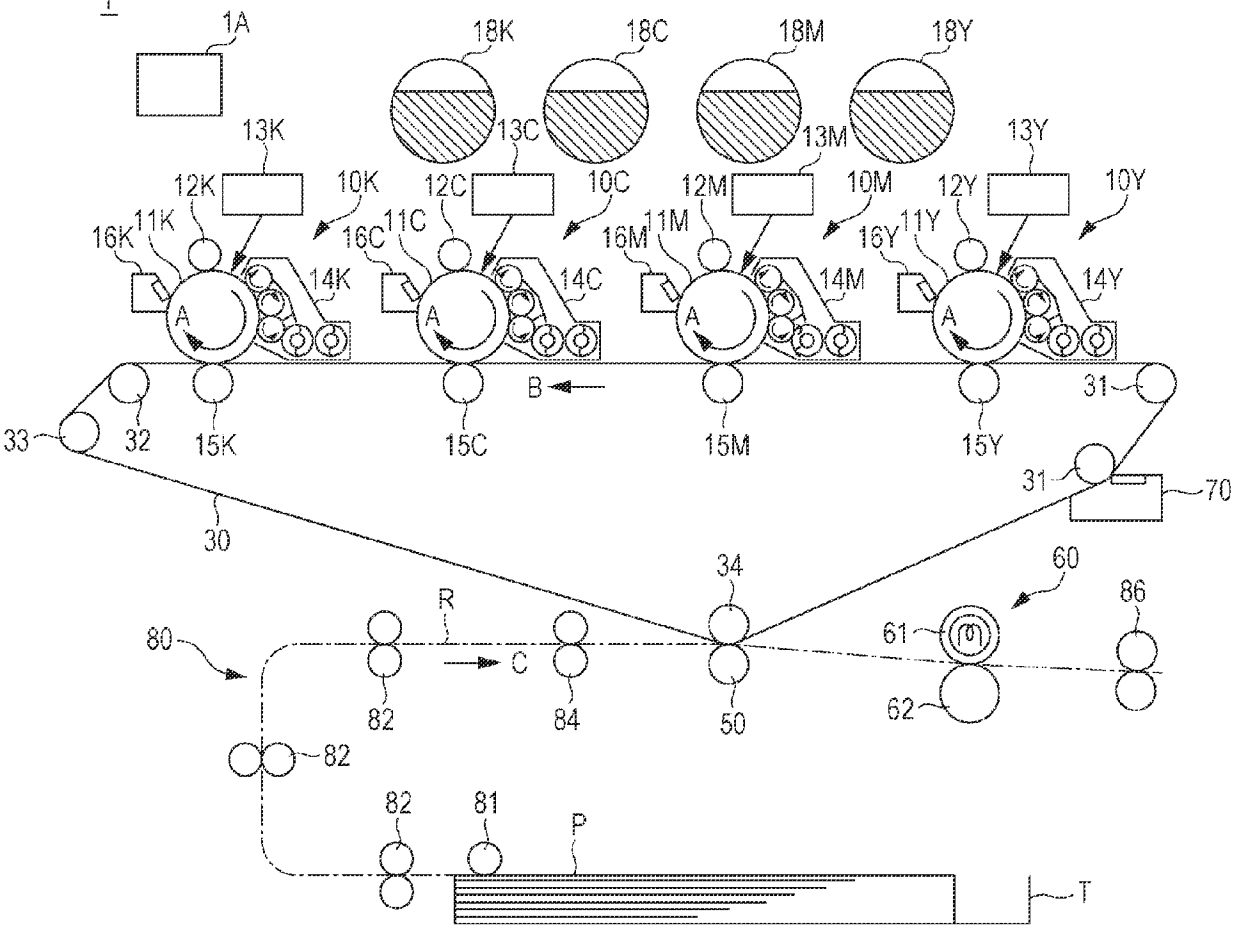
FIG. 1 illustrates the structure of an image forming apparatus according to an exemplary embodiment of the present invention.

FIG. 1 illustrates the structure of an image forming apparatus according to the exemplary embodiment of the present invention.

An image forming apparatus 1 shown in FIG. 1 is a tandem color printer formed by disposing in parallel image forming sections 10Y, 10M, 10C, and 10K for respective colors, yellow (Y), magenta (M), cyan (C), and black (K). The image forming apparatus 1 is capable of printing a full-color image including toner images of four colors in addition to being capable of printing a monochromatic image.

The image forming apparatus 1 includes toner cartridges 18Y, 18M, 18C, and 18K that contain toners of the corresponding colors, Y, M, C, and K.

Since the four image forming sections 10Y, 10M, 10C, and 10K have the same structures including their sizes and materials, the image forming section 10Y corresponding to yellow will be described as a typical example. The image forming section 10Y includes a photoconductor member 11Y, a charging unit 12Y, an exposure unit 13Y, a developing device 14Y, a first transfer unit 15Y, and a photoconductor-member cleaner 16Y. The components that make up the image forming section 10Y excluding the exposure unit 13Y and the first transfer unit 15Y constitute what is called a process cartridge. Each process cartridge has a common structure.

The photoconductor member 11Y includes a photoconductor-member layer formed on a cylindrical substrate. The photoconductor member 11Y carries an image formed on the surface thereof, and rotates in the direction of arrow A around a cylindrical shaft. The charging unit 12Y, the exposure unit 13Y, the developing device 14Y, the first transfer unit 15Y, and the photoconductor-member cleaner 16Y are successively disposed around the photoconductor member 11Y. The photoconductor member 11Y corresponds to an exemplary image carrier in the present invention. A combination of the charging unit 12Y and the exposure unit 13Y corresponds to an exemplary latent image forming unit in the present invention. The developing device 14Y corresponds to a developing device according to the exemplary embodiment of the present invention.

The charging unit 12Y charges the surface of the photoconductor member 11Y. The charging unit 12Y in the exemplary embodiment is a charging roller that contacts the surface of the photoconductor member 11Y. A voltage having the same polarity as a toner charging polarity in the developing device 14Y is applied to the charging roller, so that the surface of the photoconductor member 11Y that contacts the charging roller is charged. As the charging unit 12Y, in addition to a charging roller, a noncontact corona discharger or the like that does not contact the photoconductor member 11Y may also be used.

The exposure unit 13Y includes a light-emitting unit and a rotating polygonal mirror. The light-emitting unit emits laser light on the basis of an image signal supplied from the outside of the image forming apparatus 1. The rotating polygonal mirror is used for scanning the photoconductor member 11Y with the laser light. By irradiating the photoconductor member 11Y with the laser light, the surface of the photoconductor member 11Y is exposed thereto, so that a latent image is electrostatically formed on the surface of the photoconductor member 11Y. As the exposure unit 13Y, in addition to one using laser light, for example, a light-emitting diode (LED) array including many LEDs disposed along a scanning direction may also be used. As the latent image forming unit, in addition to a unit of an exposure type, for example, a unit directly forming a latent image using many electrodes that are disposed along a scanning direction may also be used.

The developing device 14Y performs development on the surface of the photoconductor member 11Y using a two-component developer containing toner and magnetic carriers. The toner cartridge 18Y supplies toner to the developing device 14Y. The toner is mixed with the magnetic carriers in the developing device 14Y. The magnetic carriers are each formed by applying, for example, a resin coating to a surface of iron powder. Toner particles are formed of materials such as binding resin, a coloring agent, or a separation agent. The developing device 14Y develops the latent image on the surface of the photoconductor member 11Y using charged toner by charging the toner and the magnetic carriers as a result of stirring the developer in which magnetic carrier particles and the toner particles are mixed. By the development, a toner image is formed on the surface of the photoconductor member 11Y.

The first transfer unit 15Y is a roller that opposes the photoconductor member 11Y with an intermediate transfer belt 30 being interposed therebetween. The first transfer unit 15Y includes a conductive elastic layer formed on the surface thereof. By applying a voltage having a polarity that is opposite to the toner charging polarity, the toner image on the photoconductor member 11Y is electrostatically attracted to the intermediate transfer belt 30. The photoconductor cleaner 16Y is provided with a cleaning blade that contacts the surface of the photoconductor member 11Y, and cleans the surface of the photoconductor member 11Y after the transfer. More specifically, residual toner, an external additive, or paper powder is scraped off from the surface of the photoconductor member 11Y by the cleaning blade.

The image forming apparatus 1 is provided with a controller 1A that controls the intermediate transfer belt 30, a fixing device 60, a sheet transporting section 80, and the other portions of the image forming apparatus 1. The intermediate transfer belt 30 is an endless belt formed of a resin material containing an antistatic agent. The intermediate transfer belt 30 is placed on belt supporting rollers 31 to 35, and circulates in the direction of arrow B past the image forming sections 10Y, 10M, 10C, and 10K, and a second transfer unit 50. Toner images of the respective colors are transferred to the intermediate transfer belt 30 from the image forming sections 10Y, 10M, 10C, and 10K. The intermediate transfer belt 30 moves while carrying the toner images of the respective colors.

The second transfer unit 50 is a roller that rotates with the intermediate transfer belt 30 and a sheet being nipped between the intermediate transfer unit 50 and a backup roller 34 that is one of the belt supporting rollers 31 to 35. The second transfer unit 50 includes a conductive elastic layer formed on the surface thereof. By applying a voltage having a polarity that is opposite to the toner charging polarity to the second transfer unit 50, the toner images on the intermediate transfer belt 30 are electrostatically attracted to the sheet. A combination of the first transfer unit 15Y, the intermediate transfer belt 30, and the second transfer unit 50 corresponds to an exemplary transfer unit in the present invention. As the transfer unit, a direct transfer unit that directly transfers the toner images to the sheet from the photoconductor members of the corresponding image forming sections 10Y, 10M, 10C, and 10K may also be used.

A belt cleaner 70 scrapes off toner on the intermediate transfer belt 30 when its blade contacts the intermediate transfer belt 30.

The fixing device 60 fixes the toner to a sheet. The fixing device 60 includes a heating roller 60 and a pressure roller 62.

A heater is built in the heating roller 61. By passing between the heating roller 61 and the pressure roller 62 the sheet on which the unfixed toner images are formed while nipping the sheet between the rollers 61 and 62, the toner images are fixed to the sheet. The fixing device 60 corresponds to an exemplary fixing unit in the present invention. As the fixing unit, a unit of a type that is integrated to the transfer unit for executing transfer and fixing at the same time may be used in addition to the type that is separated from the transfer unit.

The sheet transporting section 80 includes a takeout roller 81, handling rollers 82, transporting rollers 83, registration rollers 84, and discharge rollers 86. The takeout roller 81 takes out sheets contained in a sheet container T. The handling rollers 82 handle the sheets that are taken out. The transporting rollers 83 transport the sheets. The registration rollers 84 transport the sheets to the second transfer unit 50. The discharge rollers 86 discharge the sheets to the outside of the image forming apparatus 1. The sheet transporting section 80 transports the sheets along a sheet transport path R through the second transfer unit 50 and the fixing device 60.

A basic operation of the image forming apparatus 1 shown in FIG. 1 will be described. In the yellow image forming section 10Y, the photoconductor member 11Y is rotationally driven in the direction of arrow A, and electric charge is applied to the surface of the photoconductor member 11 by the charging unit 12Y. The exposure unit 13Y irradiates the surface of the photoconductor member 11Y with exposure light based on an image signal corresponding to yellow among externally supplied image signals, to form an electrostatic latent image on the surface of the photoconductor member 11Y. The developing device 14Y develops the electrostatic latent image with toner, to form a toner image. Yellow toner is not necessarily supplied to the developing device 14Y from the toner cartridge 18Y at the same time as the development. It may be supplied to the developing device 14Y from the toner cartridge 18Y when necessary. The photoconductor member 11Y rotates while carrying the yellow toner image formed on the surface thereof. The toner image formed on the surface of the photoconductor member 11Y is transferred to the intermediate transfer belt 30 by the first transfer unit 15Y. Any residual toner remaining on the photoconductor member 11Y after the transfer is collected and removed by the photoconductor-member cleaner 16Y.

The intermediate transfer belt 30 is placed on the supporting rollers 31 to 35, and circulate in the direction of arrow B. Like the yellow image forming section 10Y, the image forming sections 10M, 10C, and 10K corresponding to the colors other than yellow form toner images of the colors corresponding to the image forming sections, and are superimposed on the toner image transferred to the intermediate transfer belt 30 at the yellow image forming section 10Y. As a result, the toner images of the corresponding colors are transferred. Therefore, the Y, M, C, and K toner images are superimposed upon each other on the intermediate transfer belt 30.

From the sheet container T, the sheets P are taken out by the takeout roller 81. The transporting rollers 83 and the registration rollers 84 transport the sheets P along the sheet transport path R in the direction of arrow C towards the second transfer unit 50. The registration rollers 84 send the sheets P to the second transfer unit 50 on the basis of a timing in which the toner images are transferred to the intermediate transfer belt 30. By applying a transfer voltage to a location between the intermediate transfer belt 30 and the sheet P, the second transfer unit 50 transfers the toner images on the intermediate transfer belt 30 to the sheet P. The sheet P to which the toner images have been transferred is transported to the fixing device 60 from the second transfer unit 50, to fix the toner images that have been transferred to the sheet P. In this way, an image is formed on the sheet. The sheet on which the image has been formed is discharged to the outside of the image forming apparatus 1 by the discharge rollers 86. Any toner remaining on the intermediate transfer belt 30 after the transfer by the second transfer unit 50 is removed by the belt cleaner 70.

Next, the structure of the developing device will be described.

Figure 2:
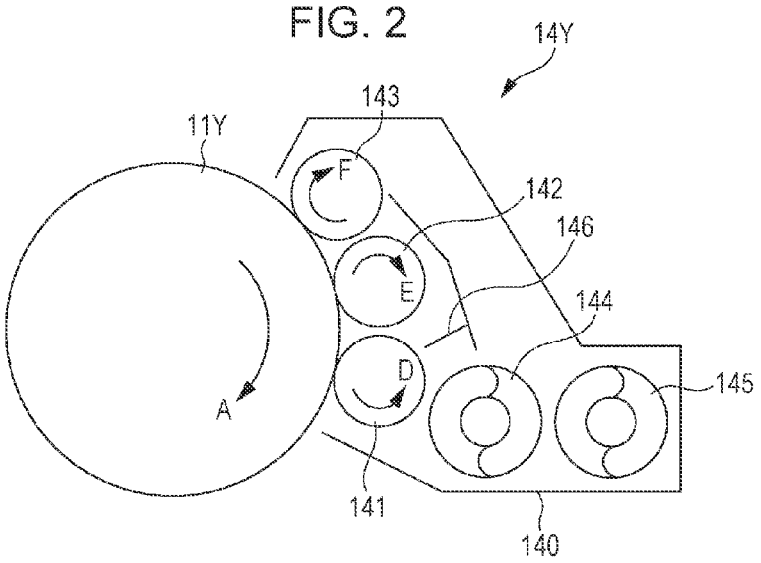
FIG. 2 is a sectional view of a developing device shown in FIG. 1.

FIG. 2 is a vertical sectional view of the developing device shown in FIG. 1. In FIG. 2, the developing device 14Y for yellow is shown. The structures of the developing devices 14M to 14K for the other colors are the same as that of the developing device 14Y. For convenience sake, the photoconductor member 11Y is also shown in FIG. 2.

The developing device 14Y includes a developer container 140, a first magnet roller 141, a second magnet roller 142, a third magnet roller 143, a first stirring transporting member 144, a second stirring transporting member 145, and a layer regulating member 146. Of the three magnet rollers 141, 142, and 143, the first magnet roller 141 corresponds to an exemplary first developer carrier in the present invention and the second magnet roller 142 corresponds to a second exemplary developer carrier in the present invention. The two stirring transporting members 144 and 145 correspond to exemplary supplying sections in the present invention. The layer regulating member 146 corresponds to an exemplary layer thickness regulating member in the present invention.

The first magnet roller 141, the second magnet roller 142, and the third magnet roller 143 are cylindrical rollers, and extend in a direction of extension of the photoconductor member 11Y. Magnets are provided in the interiors of the three magnet rollers 141, 142, and 143. The magnets are secured to the developer container 140. The magnets have magnetic poles that attract the developer containing magnetic carriers to the peripheral surfaces of the magnet rollers 141, 142, and 143.

The developer container 140 contains the developer in the interior thereof. The first stirring transporting member 144 is disposed adjacent to the first magnet roller 141. The second stirring transporting member 145 is disposed opposite the first magnet roller 141 with the first stirring transporting member 144 being disposed therebetween.

The two stirring transporting members 144 and 145 extend in a direction of extension of the three magnet rollers 141, 142, and 143. The stirring transporting members 144 and 145 each include a rotating shaft extending in parallel with the magnet rollers, and a spiral blade provided near the rotating shaft. Both end portions of the rotating shaft of each of the stirring transporting members 144 and 145 are rotatably supported by the developer container 140.

The three magnet rollers 141, 142, and 143, and the two stirring transporting members 144 and 145 are rotated by being driven by a motor (not shown).

The first stirring transporting member 144 rotates around an axis of the rotating shaft to stir the developer in the developer container 140 while transporting the developer in a first transport direction along the direction of extension. The second stirring transporting member 145 rotates around an axis of the rotating shaft to stir the developer in the developer container 140 while transporting the developer in a second transport direction that is opposite the first transport direction. Therefore, the developer is stirred while circulating in the developer container 140. By the stirring, the toner in the developer slides and rubs against the magnetic carriers, and is charged. By transporting and stirring the developer in this way, the developer behaves as a fluid in which the toner and the magnetic carriers are integrally formed. The two stirring transporting members 144 and 145 cause the developer to circulate in the developer container 140, so that a portion of the developer is supplied to the peripheral surface of the first magnet roller 141, and is attracted to the peripheral surface of the first magnet roller 141 by the magnetic pole disposed in the first magnet roller 141.

As the first magnet roller 141 rotates, the developer supplied and attracted to the peripheral surface of the first magnet roller 141 flows in the illustrated direction of arrow D and enters a location between the layer regulating member 146 and the first magnet roller 141. The layer regulating member 146 is a plate member, is disposed with a gap between it and the first magnet roller 141, and extends along the direction of extension of the first magnet roller 141. The developer that has moved by the rotation of the first magnet roller 141 passes through the gap between the layer regulating member 146 and the first magnet roller 141, so that the layer thickness of the developer is made uniform. When the developer passes through the gap, the developer is stirred, so that the charge amount of the toner and the magnetic carriers is increased.

As the first magnet roller 141 rotates, the developer that has passed through the gap between the layer regulating member 146 and the first magnet roller 141 moves to a location between the first magnet roller 141 and the second magnet roller 142. The second magnet roller 142 rotates in the illustrated direction of arrow E, so that a portion of the peripheral surface of the first magnet roller 141 and a portion of the peripheral surface of the second magnet roller 142 that oppose each other move in the same direction. As described later in detail, the developer that has moved to the location between the first magnet roller 141 and the second magnet roller 142 is such that a portion of the developer is transferred from the first magnet roller 141 to the second magnet roller 142 by the magnetic poles disposed in the corresponding magnet rollers 141 and 142, is attracted to and carried by the peripheral surfaces of the corresponding magnet rollers 141 and 142, and is transported towards the surface of the photoconductor member 11Y as the peripheral surfaces of the corresponding magnet rollers 141 and 142 move.

The developer that has been carried by the first magnet roller 141 and transported to the surface of the photoconductor member 11Y is transported in the same direction as the direction of movement of the surface of the photoconductor member 11Y indicated by arrow A in FIG. 2. The toner contained in the developer adheres to a portion of the surface of the photoconductor member 11Y irradiated with light (that is, an electrostatic latent image) and develops the electrostatic latent image. Any portion of the toner and any magnetic carriers that have not adhered to the photoconductor member 11Y are carried by the first magnet roller 141, and returns to the developer container 140.

The developer carried by the second magnet roller 142 and transported to the surface of the photoconductor member 11Y is transported in a direction opposite to the direction of movement of the surface of the photoconductor member 11Y, and the toner contained in the developer adheres to an electrostatic latent image on the surface of the photoconductor member 11Y, and develops the electrostatic latent image. Any portion of the toner and any magnetic carriers that have not adhered to the photoconductor member 11Y are transferred from the second magnet roller 42 to the third magnet roller 143 that rotates in the direction of arrow F in FIG. 2, are further transported as the third magnet roller 143 rotates, and finally returns to the developer container 140. Toner of an amount corresponding to the amount of toner consumed by the development is supplied to the developer container 140 from the toner cartridge 18Y (see FIG. 1).

Next, the transfer of developer between the first magnet roller 141 and the second magnet roller 142, and the transport of the developer thereafter will be described in detail.

Figure 3:
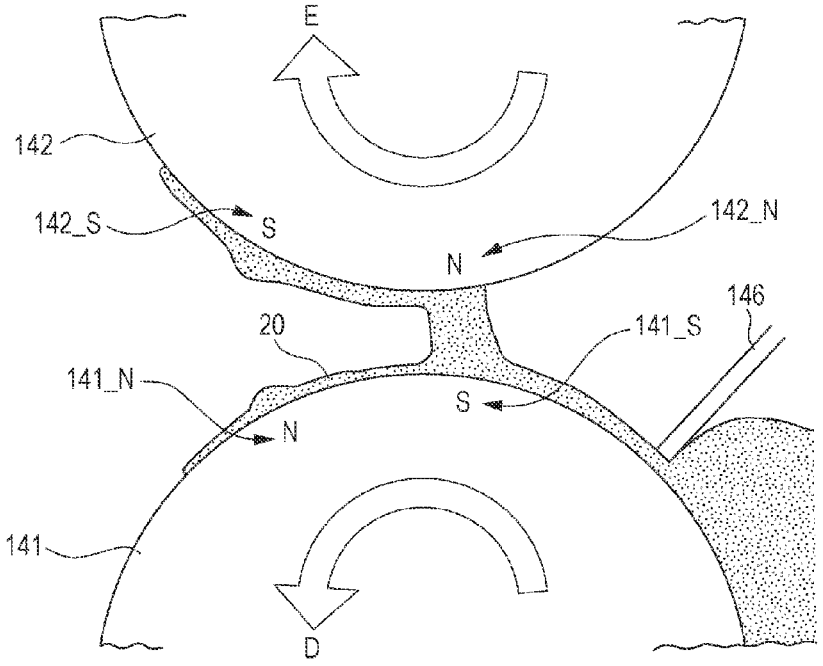
FIG. 3 illustrates the vicinity of a location where a first magnet roller and a second magnet roller are closest to each other.

FIG. 3 illustrates the vicinity of a location where the first magnet roller 141 and the second magnet roller 142 are closest to each other.

FIG. 3 illustrates the first magnet roller 141, the second magnet roller 142, and the layer regulating member 146. As described above, magnets are disposed in the corresponding magnet rollers 141 and 142, and the arrangement of magnetic poles of the magnets is illustrated in FIG. 3. In the vicinity of the location where the first magnet roller 141 and the second magnet roller 142 are closest to each other, a first S pole 141_S and a first N pole 141_N are disposed in the first magnet roller 141, and a second S pole 142_S and a second N pole 142_N are disposed in the second magnet roller 142. The first S pole 141_S and the second N pole 142_N are disposed downstream from the layer regulating member 146 in the direction of movement of the peripheral surfaces of the first magnet roller 141 and the second magnet roller 142, and primarily contribute to the transfer of developer 20 from the first magnet roller 141 to the second magnet roller 142. The first S pole 141_S corresponds to an exemplary first transfer magnetic pole in the present invention, and the second N pole 142_N corresponds to an exemplary second transfer magnetic pole in the present invention.

The first N pole 141_N and the second S pole 142_S are positioned downstream from the first S pole 141_S and the second N pole 142_N in the direction of movement of the peripheral surfaces of the first magnet roller 141 and the second magnet roller 142, and primarily contribute to the carrying of the developer 20 at the peripheral surfaces of the magnet rollers 141 and 142. The first N pole 141_N corresponds to an exemplary first downstream magnetic pole in the present invention, and the second S pole 142_S corresponds to an exemplary second downstream magnetic pole in the present invention.

Arrows D and E shown in FIG. 3 indicate the directions of movements of the peripheral surfaces of the corresponding magnet rollers 141 and 142, respectively, and also indicate the directions of movements of the developer 20 that moves along with the peripheral surfaces. The positions of the magnetic poles 141_S and 141_N in the magnet roller 141 and the positions of the magnetic poles 142_S and 142_N in the magnet roller 142 are fixed with respect to the developer container 140 (see FIG. 2). As the magnetic poles in the magnet rollers, poles opposite to those mentioned in the exemplary embodiment may be used. In addition, the first N pole 141_N and the second S pole 142_S may be disposed closer to the location where the first magnet roller 141 and the second magnet roller 142 are closest than the first S pole 141_S and the second N pole 142_N.

Figure 4A:
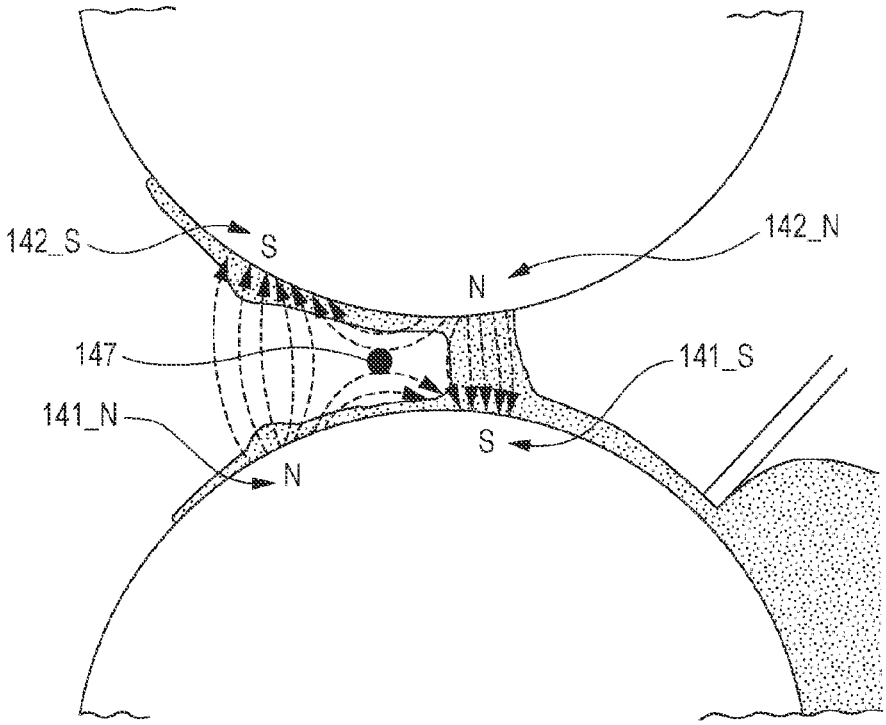
FIGS. 4A and 4B illustrate the relationships between magnetic fields formed by four magnetic poles shown in FIG. 3 and developer carried by the peripheral surfaces of the magnet rollers.
Figure 4B:
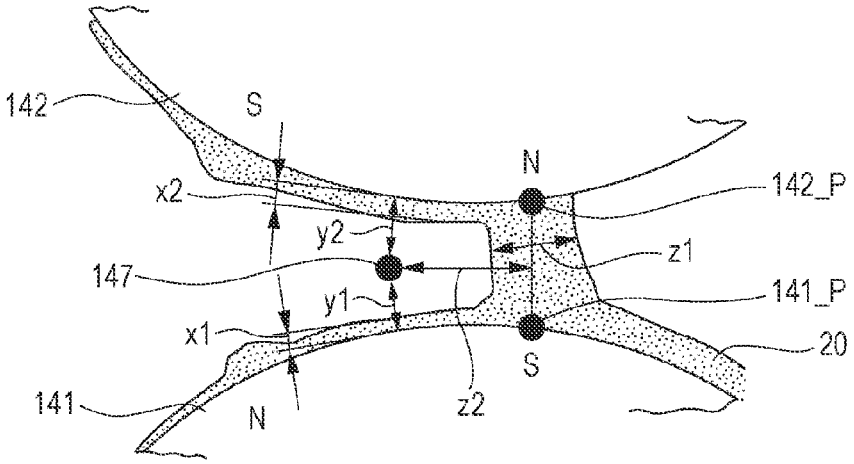

FIGS. 4A and 4B illustrate the relationships between magnetic fields formed by the four magnetic poles 141_S, 141_N, 142_S, and 142_N shown in FIG. 3 and the developer carried by the peripheral surfaces of the magnet rollers 141 and 142.

FIG. 4A shows magnetic lines of force extending between the four magnetic poles 141_S, 141_N, 142_S, and 142_N, and a point 147 where a total of strengths of magnetic fields formed by the four magnetic poles 141_S, 141_N, 142_S, and 142_N becomes zero.

FIG. 4B shows the relationships between the position of the point 147 where the total of magnetic field strengths becomes zero and the position of the developer 20.

The developer 20 carried by the peripheral surfaces of the magnet rollers 141 and 142 move while standing in the form of a chain by the magnetic fields. When a layer of the developer 20 that moves in this way is disturbed, an image formed by developing the electrostatic latent image is disturbed. In the exemplary embodiment, the relationships between the position of the point 147 where the total of magnetic field strengths becomes zero and the position of the developer 20 are as described below, and suppress such a disturbance in the layer of the developer 20.

A chain standing height x1 of the developer 20 from the peripheral surface of the first magnet roller 141 when the developer 20 on the first magnet roller 141 passes a location in a distance y1 between the peripheral surface of the first magnet roller 141 and the point 147 where the total of magnetic field strengths becomes zero has the following relationship with respect to the distance y1:y1>x1. A chain standing height x2 of the developer 20 from the peripheral surface of the second magnet roller 141 when the developer 20 on the second magnet roller 141 passes a location in a distance y2 between the peripheral surface of the second magnet roller 142 and the point 147 where the total of magnetic field strengths becomes zero has the following relationship with respect to the distance y2:y2>x2. By these relationships, the chain standing portion of the developer 20 does not reach the point 147 where the total of magnetic field strengths becomes zero, as a result of which the layer of the developer 20 on each of the magnet rollers 141 and 142 moves stably.

A distance z2 between the point 147 where the total of magnetic field strengths becomes zero and a line connecting a point 141_P (on the peripheral surface of the first magnet roller 141) corresponding to the first S pole 141_S) and a point 142_P (on the peripheral surface of the second magnet roller 142) corresponding to the second N pole 142_N) has the following relationship with respect to a width z1 of a developer transfer portion formed so as to bridge a gap between the peripheral surfaces of the magnet rollers 141 and 142 by transferring the developer 20 between the first S pole 141_S and the second N pole 142_N: z2>z1/2. By this relationship, even when the developer 20 is transferred between the first S pole 141_S and the second N pole 142_N, the chain standing portion of the developer 20 does not reach the point 147 where the total of magnetic field strengths becomes zero. As a result, any disturbance in the layer of the developer 20 caused by a disturbance in the transfer is suppressed, so that the layer of the developer 20 on each of the magnet rollers 141 and 142 moves more stably.

Here, a method of measuring x1, x2, and z1 in the developer 20 will be described.

x1 and x2 are calculated from the difference between average distances A and B, which are measured by an optical displacement meter (a three-dimensional measuring instrument using laser) disposed so as to be spaced apart from the peripheral surfaces of the magnet rollers 141 and 142. The average distance A is a distance to the peripheral surfaces of the magnet rollers 141 and 142 that are being rotationally driven while the developer 20 does not exist. The average distance B is a distance to the surface of the layer of the developer 20 that is being rotationally driven with the layer of the developer 20 being in a formed state. The locations at the magnet rollers 141 and 142 where x1 and x2 are to be measured are near the location where the magnet rollers 141 and 142 are closest to each other. Therefore, it may be difficult to set the optical displacement meter. In such a case, it is possible to make measurements at locations that are downstream from the locations where x1 and x2 are to be measured in the direction of movement of the peripheral surfaces of the magnet rollers 141 and 142 or at locations similar to locations where the orientations of magnetic fluxes that are formed are to be measured. More specifically, if it is confirmed that chain standing portion of the developer 20 lies on the locations where x1 and x2 are to be measured, it is possible to make measurements at a location existing further downstream where the chain standing portion of the developer 20 lies.

z1 is measured by inserting a measurement scale into the developer transfer portion while the developing device 14Y is stopped. More specifically, in order for the front and back of the developer receiving portion (that is, a side that is adjacent to the photoconductor member 11Y and a far side of the developing device 14Y) to be visually observed, a side portion, a top portion, or a back portion of the developer container 140 is removed, to insert the measurement scale into the developer transfer portion, and to measure z1. The side portion or the like of the developer container 140 is removed so that the developer transfer portion is not deformed.

Next, a case of a typical disturbance in the developer 20 will be described.

Figure 5:
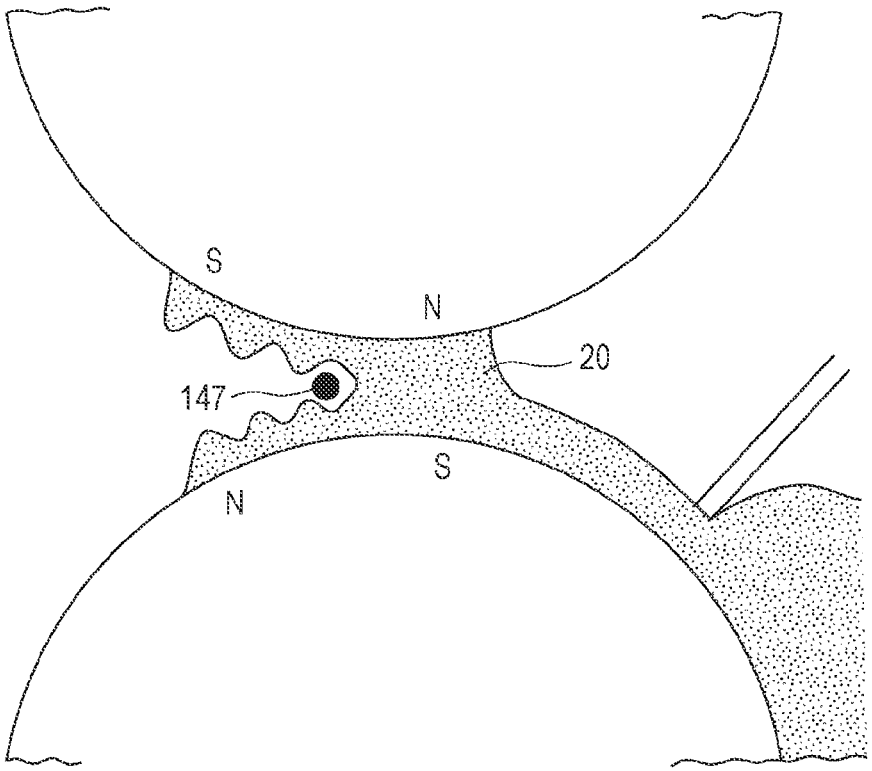
FIG. 5 shows a first case in which the developer is disturbed.

FIG. 5 shows a first case in which the developer is disturbed.

In the case shown in FIG. 5, the layer of developer 20 is disturbed because the amount of developer 20 is too large. At this time, a chain standing portion of the developer 20 has reached the point 147 where the total of magnetic field strengths becomes zero, and a chain standing portion at the developer transfer portion has also reached the point 147 where the total of magnetic field strengths becomes zero.

Figure 6:
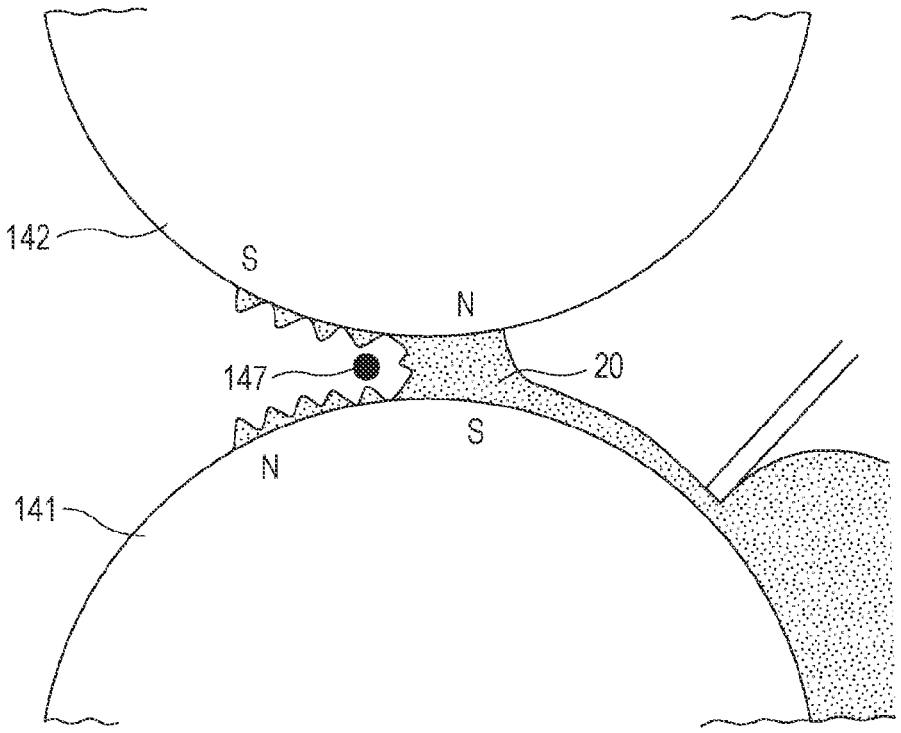
FIG. 6 shows a second case in which the developer is disturbed.

FIG. 6 shows a second case in which the developer 20 is disturbed.

In the case shown in FIG. 6, the layer of developer 20 is disturbed because the distance between the first magnet roller 141 and the second magnet roller 142 is too small. At this time, a chain standing portion of the developer 20 has reached the point 147 where the total of magnetic field strengths becomes zero.

Figure 7:
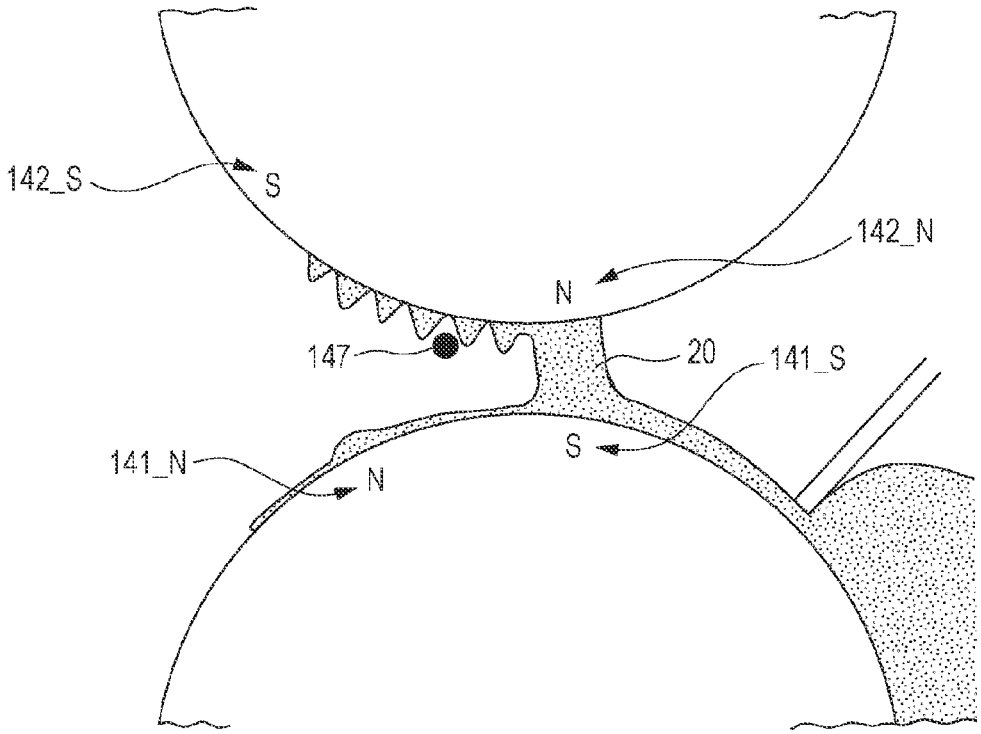
FIG. 7 shows a third case in which the developer is disturbed.

FIG. 7 shows a third case in which the developer 20 is disturbed.

In the case shown in FIG. 7, the layer of developer 20 is disturbed because the arrangement of the four magnetic poles 141_S, 141_N, 142_S, and 142_N is an unbalanced arrangement. At this time, the position of the point 147 where the total of magnetic field strengths becomes zero is situated towards a certain side, and a chain standing portion of the developer 20 has reached the point 147 where the total of magnetic field strengths becomes zero.

Figure 8:
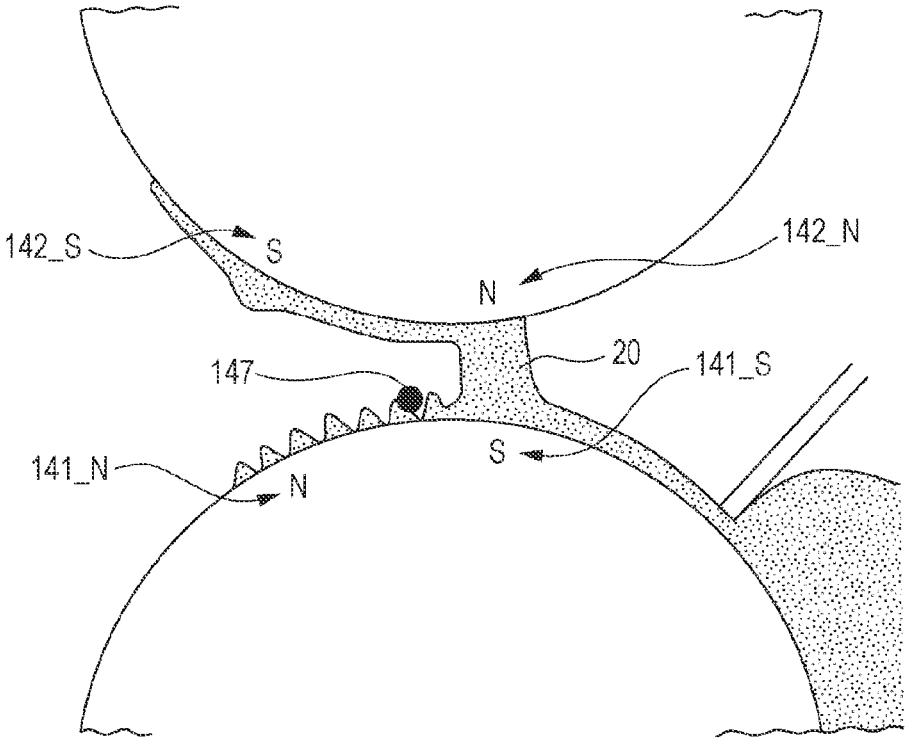
FIG. 8 shows a fourth case in which the developer is disturbed.

FIG. 8 shows a fourth case in which the developer 20 is disturbed.

In the case shown in FIG. 8, the layer of developer 20 is disturbed because the magnetic flux densities of the four magnetic poles 141_S, 141_N, 142_S, and 142_N are unbalanced (more specifically, the magnetic flux density of the first S pole 141_S is small). Even at this time, the position of the point 147 where the total of magnetic field strengths becomes zero is situated towards a certain side, and a chain standing portion of the developer 20 has reached the point 147 where the total of magnetic field strengths becomes zero.

As understood from the typical cases described above, the layer of developer 20 tends to be disturbed when a chain standing portion of the developer 20 reaches the point 147 where the total of magnetic field strengths becomes zero.

For example, specific arrangements of magnetic poles that allow the relationships between the magnetic fields and the developer illustrated in FIGS. 4A and 4B to be obtained are studied.

Figure 9:
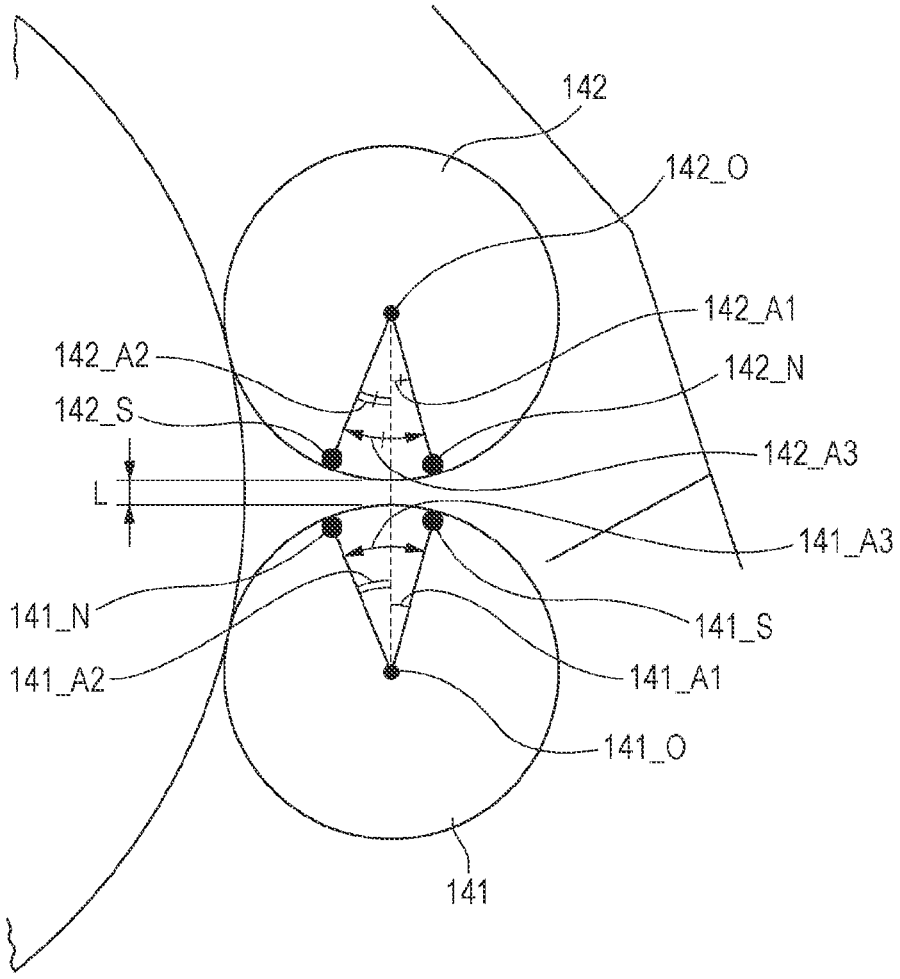
FIG. 9 illustrates, for example, an arrangement of the magnetic poles that allows the relationships between the magnetic fields and the developer shown in FIGS. 4A and 4B to be obtained.

FIG. 9 illustrates, for example, an arrangement of the magnetic poles that allows the relationships between the magnetic fields and the developer shown in FIGS. 4A and 4B to be obtained.

In the arrangement shown in FIG. 9, the magnetic flux density of the first S pole 141_S and the magnetic flux density of the second N pole 142_N are from 50 mT to 90 mT. However, the magnetic flux density of the first S pole 141_S and the second N pole 142_N may be different from each other. The magnetic flux density of the first N pole 141_N and the magnetic flux density of the second S pole 142_S are from 70 mT to 120 mT. The magnetic flux density of the first N pole 141_N and the magnetic flux density of the second S pole 142_S may also be different from each other.

Angles 141_A1 and 142_A1 are from zero degrees to 15 degrees. The angle 141_A1 is formed between a line connecting the center 141_O of the first magnet roller 141 and the center 142_O of the second magnet roller 142 (that is, a line extending through the location where the first magnet roller 141 and the second magnet roller 142 are closest to each other) and a line connecting the first S pole 141S and the center 141_O. The angle 142_A1 is formed between the line connecting the center 141_O of the first magnet roller 141 and the center 142_O of the second magnet roller 142 and a line connecting the second N pole 142_N and the center 142_O. That is, with respect to the location where the magnet rollers 141 and 142 are closest to each other, the first S pole 141_S and the second N pole 142_N are positioned in an angular range of from zero degrees to 15 degrees as viewed from the corresponding centers 141_O and 142_O. However, the first S pole 141_S and the second N pole 142_N may be positioned in different angular directions from the location where the magnet rollers 141 and 142 are closest to each other.

Angles 141_A2 and 142_A2 are from 20 degrees to 40 degrees. The angle 141_A2 is formed between the line connecting the center 141_O and the center 142_O and a line connecting the first N pole 141N and the center 141_O. The angle 142_A2 is formed between the line connecting the center 141_O and the center 142_O and a line connecting the second S pole 142_S and the center 142_O. That is, with respect to the location where the magnet rollers 141 and 142 are closest to each other, the first N pole 141_N and the second S pole 142_S are positioned in an angular range of from 20 degrees to 40 degrees as viewed from the corresponding centers 141_O and 142_O. However, the first N pole 141_N and the second S pole 142_S may be positioned in different angular directions from the line connecting the centers 141_O and 142_O.

Further, as viewed from the centers 141_O and 142_O, an opening angle 141_A3 between the first S pole 141_S and the first N pole 141_N and an opening angle 142_A3 between the second S pole 142_S and the second N pole 142_N are from 20 degrees to 40 degrees, respectively.

When the magnetic poles 141_S, 141_N, 142_S, and 142_N exist at the corresponding positions, as viewed from the respective centers 141_O and 142_O, the point where the total of magnetic field strengths becomes zero exists in an angular range of from 10 degrees to 20 degrees from the location where the magnet rollers 141 and 142 are closest to each other. Even if, for example, any displacement in the position of a magnet roller with respect to a magnet is considered, the amount of displacement of the point where the total of magnetic field strengths becomes zero with respect to an equivalent distance line from the magnet roller 141 and that from the magnet roller 142 is on the order of ±1.0 mm.

Therefore, in the case where the layer thicknesses of developer (that is, x1 and x2) are from 0.1 mm to 0.5 mm, when a distance L between the first magnet roller 141 and the second magnet roller 142 is greater than 3.0 mm, the relations between the magnet field and developer shown in FIGS. 4A and 4B are obtained.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a first developer carrier that carries developer on a peripheral surface thereof and that rotates in a peripheral direction of the peripheral surface, the developer containing toner and a magnetic material;

a second developer carrier that carries the developer on a peripheral surface thereof and that rotates in a peripheral direction of the peripheral surface of the second developer carrier, the peripheral surface of the second developer carrier opposing the peripheral surface of the first developer carrier, a portion of the peripheral surface of the first developer carrier and a portion of the peripheral surface of the second developer carrier that oppose each other moving in a same direction;

a supplying section that supplies the developer to the peripheral surface of the first developer carrier;

a layer thickness regulating member that regulates a layer thickness of the developer supplied to the peripheral surface of the first developer carrier by the supplying section;

a first transfer magnetic pole that is disposed in an interior of the first developer carrier, the first transfer magnetic pole being positioned downstream in a direction of movement of the peripheral surface of the first developer carrier from a position where the layer thickness of the developer is regulated by the layer thickness regulating member, the first transfer magnetic pole contributing to transfer of the developer from the first developer carrier to the second developer carrier;

a second transfer magnetic pole that is disposed in an interior of the second developer carrier, the second transfer magnetic pole being positioned downstream in a direction of movement of the peripheral surface of the second developer carrier from the position where the layer thickness of the developer is regulated by the layer thickness regulating member, the second transfer magnetic pole contributing to, along with the first transfer magnetic pole, the transfer of the developer, a polarity of the second transfer magnetic pole being opposite to that of the first transfer magnetic pole;

a first downstream magnetic pole that is disposed in the interior of the first developer carrier, the first downstream magnetic pole being positioned downstream from the first transfer magnetic pole in the direction of movement of the peripheral surface of the first developer carrier, the first downstream magnetic pole causing the developer to be carried by the peripheral surface of the first developer carrier, a polarity of the first downstream magnetic pole being opposite to that of the first transfer magnetic pole; and a second downstream magnetic pole that is disposed in the interior of the second developer carrier, the second downstream magnetic pole being positioned downstream from the second transfer magnetic pole in the direction of movement of the peripheral surface of the second developer carrier, the second downstream magnetic pole causing the developer to be carried by the peripheral surface of the second developer carrier, a polarity of the second downstream magnetic pole being opposite to that of the second transfer magnetic pole, wherein the developer that is carried by the peripheral surface of the first developer carrier and that moves while standing in the form of a chain from the peripheral surface of the first developer carrier by a magnetic field is such that a chain standing height from the peripheral surface of the first developer carrier when the developer passes between a point where a total of magnetic field strengths becomes zero and the peripheral surface of the first developer carrier is less than a distance between the point where the total of magnetic field strengths becomes zero and the peripheral surface of the first developer carrier, the point where the total of magnetic field strengths becomes zero being where the total of magnetic field strengths of the first transfer magnetic pole, the second transfer magnetic pole, the first downstream magnetic pole, and the second downstream magnetic pole becomes zero, and wherein the developer that is carried by the peripheral surface of the second developer carrier and that moves while standing in the form of a chain from the peripheral surface of the second developer carrier by a magnetic field is such that a chain standing height from the peripheral surface of the second developer carrier when the developer passes between the point where the total of magnetic field strengths becomes zero and the peripheral surface of the second developer carrier is less than a distance between the point where the total of magnetic field strengths becomes zero and the peripheral surface of the second developer carrier.

2. The developing device according to claim 1, wherein a distance between the point where the total of magnetic field strengths becomes zero and a line connecting a position on the peripheral surface of the first developer carrier corresponding to the first transfer magnetic pole and a position on the peripheral surface of the second developer carrier corresponding to the second transfer magnetic pole is greater than half a width of a portion of the developer that is transferred between the first developer carrier and the second developer carrier.

3. A developing device comprising:

a first developer carrier that carries developer on a peripheral surface thereof and that rotates in a peripheral direction of the peripheral surface, the developer containing toner and a magnetic material;

a second developer carrier that carries the developer on a peripheral surface thereof and that rotates in a peripheral direction of the peripheral surface of the second developer carrier, the peripheral surface of the second developer carrier opposing the peripheral surface of the first developer carrier, a portion of the peripheral surface of the first developer carrier and a portion of the peripheral surface of the second developer carrier that oppose each other moving in a same direction;

a supplying section that supplies the developer to the peripheral surface of the first developer carrier;

a layer thickness regulating member that regulates a layer thickness of the developer supplied to the peripheral surface of the first developer carrier by the supplying section;

a first transfer magnetic pole that is disposed in an interior of the first developer carrier, the first transfer magnetic pole being positioned downstream in a direction of movement of the peripheral surface of the first developer carrier from a position where the layer thickness of the developer is regulated by the layer thickness regulating member, the first transfer magnetic pole contributing to transfer of the developer from the first developer carrier to the second developer carrier;

a second transfer magnetic pole that is disposed in an interior of the second developer carrier, the second transfer magnetic pole being positioned downstream in a direction of movement of the peripheral surface of the second developer carrier from the position where the layer thickness of the developer is regulated by the layer thickness regulating member, the second transfer magnetic pole contributing to, along with the first transfer magnetic pole, the transfer of the developer, a polarity of the second transfer magnetic pole being opposite to that of the first transfer magnetic pole;

a first downstream magnetic pole that is disposed in the interior of the first developer carrier, the first downstream magnetic pole being positioned downstream from the first transfer magnetic pole in the direction of movement of the peripheral surface of the first developer carrier, the first downstream magnetic pole causing the developer to be carried by the peripheral surface of the first developer carrier, a polarity of the first downstream magnetic pole being opposite to that of the first transfer magnetic pole; and a second downstream magnetic pole that is disposed in the interior of the second developer carrier, the second downstream magnetic pole being positioned downstream from the second transfer magnetic pole in the direction of movement of the peripheral surface of the second developer carrier, the second downstream magnetic pole causing the developer to be carried by the peripheral surface of the second developer carrier, a polarity of the second downstream magnetic pole being opposite to that of the second transfer magnetic pole, wherein the first transfer magnetic pole and the second transfer magnetic pole each have a magnetic flux density of from 50 mT to 90 mT, wherein the first downstream magnetic pole and the second downstream magnetic pole each have a magnetic flux density of from 70 mT to 120 mT, wherein the developer that is carried by the peripheral surface of the first developer carrier and that moves while standing in the form of a chain from the peripheral surface of the first developer carrier by a magnetic field is such that a chain standing height from the peripheral surface of the first developer carrier when the developer passes between a point where a total of magnetic field strengths becomes zero and the peripheral surface of the first developer carrier is from 0.1 mm to 0.5 mm, and the developer that is carried by the peripheral surface of the second developer carrier and that moves while standing in the form of a chain from the peripheral surface of the second developer carrier by a magnetic field is such that a chain standing height from the peripheral surface of the second developer carrier when the developer passes between the point where the total of magnetic field strengths becomes zero and the peripheral surface of the second developer carrier is from 0.1 mm to 0.5 mm, the point where the total of magnetic field strengths becomes zero being where the total of magnetic field strengths of the first transfer magnetic pole, the second transfer magnetic pole, the first downstream magnetic pole, and the second downstream magnetic pole becomes zero, wherein, when viewed from a center of the first developer carrier and a center of the second developer carrier, respectively, the first transfer magnetic pole and the second transfer magnetic pole are positioned in an angular range of from zero degrees to 15 degrees with respect to a location where the first developer carrier and the second developer carrier are closest to each other, wherein, when viewed from the center of the first developer carrier and the center of the second developer carrier, respectively, the first downstream magnetic pole and the second downstream magnetic pole are positioned in an angular range of from 20 degrees to 40 degrees with respect to the location where the first developer carrier and the second developer carrier are closest to each other, wherein, when viewed from the center of the first developer carrier, an opening angle between the first transfer magnetic pole and the first downstream magnetic pole is from 20 degrees to 40 degrees, and, when viewed from the center of the second developer carrier, an opening angle between the second transfer magnetic pole and the second downstream magnetic pole is from 20 degrees to 40 degrees, and wherein a distance at which the first developer carrier and the second developer carrier are closest to each other is greater than 3.0 mm.

4. An image forming apparatus comprising:

a developing device including a first developer carrier that carries developer on a peripheral surface thereof and that rotates in a peripheral direction of the peripheral surface, the developer containing toner and a magnetic material, a second developer carrier that carries the developer on a peripheral surface thereof and that rotates in a peripheral direction of the peripheral surface of the second developer carrier, the peripheral surface of the second developer carrier opposing the peripheral surface of the first developer carrier, a portion of the peripheral surface of the first developer carrier and a portion of the peripheral surface of the second developer carrier that oppose each other moving in a same direction, a supplying section that supplies the developer to the peripheral surface of the first developer carrier, a layer thickness regulating member that regulates a layer thickness of the developer supplied to the peripheral surface of the first developer carrier by the supplying section, a first transfer magnetic pole that is disposed in an interior of the first developer carrier, the first transfer magnetic pole being positioned downstream in a direction of movement of the peripheral surface of the first developer carrier from a position where the layer thickness of the developer is regulated by the layer thickness regulating member, the first transfer magnetic pole contributing to transfer of the developer from the first developer carrier to the second developer carrier, a second transfer magnetic pole that is disposed in an interior of the second developer carrier, the second transfer magnetic pole being positioned downstream in a direction of movement of the peripheral surface of the second developer carrier from the position where the layer thickness of the developer is regulated by the layer thickness regulating member, the second transfer magnetic pole contributing to, along with the first transfer magnetic pole, the transfer of the developer, a polarity of the second transfer magnetic pole being opposite to that of the first transfer magnetic pole, a first downstream magnetic pole that is disposed in the interior of the first developer carrier, the first downstream magnetic pole being positioned downstream from the first transfer magnetic pole in the direction of movement of the peripheral surface of the first developer carrier, the first downstream magnetic pole causing the developer to be carried by the peripheral surface of the first developer carrier, a polarity of the first downstream magnetic pole being opposite to that of the first transfer magnetic pole, and a second downstream magnetic pole that is disposed in the interior of the second developer carrier, the second downstream magnetic pole being positioned downstream from the second transfer magnetic pole in the direction of movement of the peripheral surface of the second developer carrier, the second downstream magnetic pole causing the developer to be carried by the peripheral surface of the second developer carrier, a polarity of the second downstream magnetic pole being opposite to that of the second transfer magnetic pole, wherein the developer that is carried by the peripheral surface of the first developer carrier and that moves while standing in the form of a chain from the peripheral surface of the first developer carrier by a magnetic field is such that a chain standing height from the peripheral surface of the first developer carrier when the developer passes between a point where a total of magnetic field strengths becomes zero and the peripheral surface of the first developer carrier is less than a distance between the point where the total of magnetic field strengths becomes zero and the peripheral surface of the first developer carrier, the point where the total of magnetic field strengths becomes zero being where the total of magnetic field strengths of the first transfer magnetic pole, the second transfer magnetic pole, the first downstream magnetic pole, and the second downstream magnetic pole becomes zero, and wherein the developer that is carried by the peripheral surface of the second developer carrier and that moves while standing in the form of a chain from the peripheral surface of the second developer carrier by a magnetic field is such that a chain standing height from the peripheral surface of the second developer carrier when the developer passes between the point where the total of magnetic field strengths becomes zero and the peripheral surface of the second developer carrier is less than a distance between the point where the total of magnetic field strengths becomes zero and the peripheral surface of the second developer carrier, an image carrier that opposes both the first developer carrier and the second developer carrier, the image carrier carrying an electrostatic latent image on a surface thereof, the image carrier also carrying a toner image obtained when the latent image is developed by the developer that is moved as the first developer carrier and the second developer carrier rotate;

a latent image forming unit that forms the latent image on the surface of the image carrier;

a transfer unit that transfers the toner image on the image carrier to a recording medium; and a fixing unit that fixes the toner image on the recording medium to the recording medium.

5. An image forming apparatus comprising:

a developing device including a first developer carrier that carries developer on a peripheral surface thereof and that rotates in a peripheral direction of the peripheral surface, the developer containing toner and a magnetic material, a second developer carrier that carries the developer on a peripheral surface thereof and that rotates in a peripheral direction of the peripheral surface of the second developer carrier, the peripheral surface of the second developer carrier opposing the peripheral surface of the first developer carrier, a portion of the peripheral surface of the first developer carrier and a portion of the peripheral surface of the second developer carrier that oppose each other moving in a same direction, a supplying section that supplies the developer to the peripheral surface of the first developer carrier, a layer thickness regulating member that regulates a layer thickness of the developer supplied to the peripheral surface of the first developer carrier by the supplying section, a first transfer magnetic pole that is disposed in an interior of the first developer carrier, the first transfer magnetic pole being positioned downstream in a direction of movement of the peripheral surface of the first developer carrier from a position where the layer thickness of the developer is regulated by the layer thickness regulating member, the first transfer magnetic pole contributing to transfer of the developer from the first developer carrier to the second developer carrier, a second transfer magnetic pole that is disposed in an interior of the second developer carrier, the second transfer magnetic pole being positioned downstream in a direction of movement of the peripheral surface of the second developer carrier from the position where the layer thickness of the developer is regulated by the layer thickness regulating member, the second transfer magnetic pole contributing to, along with the first transfer magnetic pole, the transfer of the developer, a polarity of the second transfer magnetic pole being opposite to that of the first transfer magnetic pole, a first downstream magnetic pole that is disposed in the interior of the first developer carrier, the first downstream magnetic pole being positioned downstream from the first transfer magnetic pole in the direction of movement of the peripheral surface of the first developer carrier, the first downstream magnetic pole causing the developer to be carried by the peripheral surface of the first developer carrier, a polarity of the first downstream magnetic pole being opposite to that of the first transfer magnetic pole, and a second downstream magnetic pole that is disposed in the interior of the second developer carrier, the second downstream magnetic pole being positioned downstream from the second transfer magnetic pole in the direction of movement of the peripheral surface of the second developer carrier, the second downstream magnetic pole causing the developer to be carried by the peripheral surface of the second developer carrier, a polarity of the second downstream magnetic pole being opposite to that of the second transfer magnetic pole, wherein the first transfer magnetic pole and the second transfer magnetic pole each have a magnetic flux density of from 50 mT to 90 mT, wherein the first downstream magnetic pole and the second downstream magnetic pole each have a magnetic flux density of from 70 mT to 120 mT, wherein the developer that is carried by the peripheral surface of the first developer carrier and that moves while standing in the form of a chain from the peripheral surface of the first developer carrier by a magnetic field is such that a chain standing height from the peripheral surface of the first developer carrier when the developer passes between a point where a total of magnetic field strengths becomes zero and the peripheral surface of the first developer carrier is from 0.1 mm to 0.5 mm, and the developer that is carried by the peripheral surface of the second developer carrier and that moves while standing in the form of a chain from the peripheral surface of the second developer carrier by a magnetic field is such that a chain standing height from the peripheral surface of the second developer carrier when the developer passes between the point where the total of magnetic field strengths becomes zero and the peripheral surface of the second developer carrier is from 0.1 mm to 0.5 mm, the point where the total of magnetic field strengths becomes zero being where the total of magnetic field strengths of the first transfer magnetic pole, the second transfer magnetic pole, the first downstream magnetic pole, and the second downstream magnetic pole becomes zero, wherein, when viewed from a center of the first developer carrier and a center of the second developer carrier, respectively, the first transfer magnetic pole and the second transfer magnetic pole are positioned in an angular range of from zero degrees to 15 degrees with respect to a location where the first developer carrier and the second developer carrier are closest to each other, wherein, when viewed from the center of the first developer carrier and the center of the second developer carrier, respectively, the first downstream magnetic pole and the second downstream magnetic pole are positioned in an angular range of from 20 degrees to 40 degrees with respect to the location where the first developer carrier and the second developer carrier are closest to each other, wherein, when viewed from the center of the first developer carrier, an opening angle between the first transfer magnetic pole and the first downstream magnetic pole is from 20 degrees to 40 degrees, and, when viewed from the center of the second developer carrier, an opening angle between the second transfer magnetic pole and the second downstream magnetic pole is from 20 degrees to 40 degrees, and wherein a distance at which the first developer carrier and the second developer carrier are closest to each other is greater than 3.0 mm, an image carrier that opposes both the first developer carrier and the second developer carrier, the image carrier carrying an electrostatic latent image on a surface thereof, the image carrier also carrying a toner image obtained when the latent image is developed by the developer that is moved as the first developer carrier and the second developer carrier rotate;

a latent image forming unit that forms the latent image on the surface of the image carrier;

a transfer unit that transfers the toner image on the image carrier to a recording medium; and a fixing unit that fixes the toner image on the recording medium to the recording medium.

* * * * *